US008310426B2

(12) United States Patent
Umeda

(10) Patent No.: US 8,310,426 B2
(45) Date of Patent: Nov. 13, 2012

(54) APPARATUS AND METHOD FOR DRIVING LIQUID CRYSTAL DISPLAY PANEL WITH DATA DRIVER INCLUDING GAMMA CORRECTION CIRCUITRY AND DRIVE CIRCUITRY

(75) Inventor: Kengo Umeda, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 865 days.

(21) Appl. No.: 12/314,304

(22) Filed: Dec. 8, 2008

(65) Prior Publication Data

US 2009/0153594 A1 Jun. 18, 2009

(30) Foreign Application Priority Data

Dec. 13, 2007 (JP) ..... 2007-322401

(51) Int. Cl.
*G09G 3/36* (2006.01)

(52) U.S. Cl. ..... 345/89; 345/690

(58) Field of Classification Search ..... 345/690, 345/89, 92
See application file for complete search history.

(56) References Cited

U.S. PATENT DOCUMENTS

| | | | | |
|---|---|---|---|---|
| 6,867,759 | B1 * | 3/2005 | Baek et al. | 345/99 |
| 2006/0290626 | A1 * | 12/2006 | Arimoto et al. | 345/87 |
| 2007/0132695 | A1 * | 6/2007 | Kim | 345/98 |
| 2007/0195041 | A1 | 8/2007 | Lee | |
| 2007/0211007 | A1 * | 9/2007 | Su et al. | 345/92 |
| 2007/0263017 | A1 | 11/2007 | Umeda et al. | |
| 2008/0036718 | A1 * | 2/2008 | Lee | 345/88 |
| 2008/0136761 | A1 * | 6/2008 | Hong et al. | 345/89 |

FOREIGN PATENT DOCUMENTS

| | | |
|---|---|---|
| JP | 2007-139842 A | 6/2007 |
| JP | 2007-226196 A | 9/2007 |
| JP | 2007-226242 | 9/2007 |

OTHER PUBLICATIONS

Sang Soo Kim, "The World's Largest (82-in.) TFT-LCD", SID 05 Digest, 2005, pp. 1842-1847.
Japanese Office Action dated May 23, 2012, with partial English-language translation.

* cited by examiner

*Primary Examiner* — Chanh Nguyen
*Assistant Examiner* — Kwang-Su Yang
(74) *Attorney, Agent, or Firm* — McGinn IP Law Group, PLLC

(57) ABSTRACT

A liquid crystal display device is provided with a liquid crystal display panel, and a data driver IC that drives the liquid crystal display panel. The liquid crystal display panel is provided with a gate line, first and second data lines, and a pixel that includes a first sub-pixel connected to the gate line and the first data line and a second sub-pixel connected to the gate line and the second data line. The data driver IC is provided with a gamma correction circuitry and a drive circuitry. The gamma correction circuitry generates first gamma-corrected data by performing gamma correction on externally received image data in accordance with a first gamma curve, and generates second gamma-corrected data by performing gamma correction on the image data in accordance with a second gamma curve. The drive circuitry drives the first data line in response to the first gamma-corrected data and drives the second data line in response to the second gamma-corrected data.

2 Claims, 10 Drawing Sheets

APPARATUS AND METHOD FOR DRIVING LIQUID CRYSTAL DISPLAY PANEL WITH DATA DRIVER INCLUDING GAMMA CORRECTION CIRCUITRY AND DRIVE CIRCUITRY

INCORPORATION BY REFERENCE

This application claims the benefit of priority based on Japanese Patent Application No. 2007-322401, filed on Dec. 13, 2007, the disclosure of which is incorporated herein by reference.

BACKGROUND OF THE INVENTION

1. Field of the Invention

The present invention relates to a liquid crystal display, and more specifically to a drive technology of a liquid crystal display panel in which each pixel includes a plurality of sub-pixels.

2. Description of the Related Art

The viewing angle is one of the significant issues of the liquid crystal display device, and therefore various techniques have been proposed for improving the viewing angle. One known technique for improving the viewing angle is to compose one pixel with two or more sub-pixels and to drive the sub-pixels with different drive voltages. Typically, each pixel is composed of two sub-pixels. Driving the sub-pixels in the same pixel with different driving voltages allows orienting the liquid crystal molecules within the sub-pixels in the different directions. Such drive technique allows correcting and minimizing the distortion of the gamma curve when the image is viewed slantingly. Such technique is disclosed by Sang Soo Kim in a document titled "The World's Largest (82-in.) TFT-LCD," SID 05 DIGEST, 2005, pp. 1842-1847.

This document discloses a double data line structure in which each pixel within the liquid crystal display panel is composed of two sub-pixels. FIG. 1 is a conceptual diagram showing a typical configuration of a liquid crystal display panel that adopts the double data line structure. In the liquid crystal display panel that adopts the double data line structure, each pixel is composed of two sub-pixels, and two data lines are arranged along each line of the pixels. One of the paired data lines is connected to one of the two sub-pixels within each corresponding pixel, and the other is connected to the other of the two sub-pixels. The two sub-pixels within one pixel are connected to the same gate line.

More specifically, each dot 101 includes three pixels: an R pixel 102, a G pixel 103, and a B pixel 104. The R pixels 102 are each composed of two R sub-pixels 102A and 102B, and two data lines Ri(A), Ri(B) are provided along each column of the R pixels 102; the R sub-pixel 102A is connected to the data line Ri(A) and the R sub-pixel 102B is connected to the data line Ri(B). The R sub-pixels 102A and 102B within the same R pixel 102 are connected to the same gate line. The G pixels 103 and the B pixels 104 are each structured similarly. The G pixels 103 are each composed of two G sub-pixels 103A and 103B, and two data lines Gi(A) and Gi(B) are provided along each column of the G pixels 103. Correspondingly, the B pixels 104 are each composed of two B sub-pixels 104A and 104B, and two data lines Bi(A) and Bi(B) are provided along each column of the B pixels 104.

As shown in FIG. 2, each sub-pixel includes a TFT (thin film transistor), a liquid crystal capacitor formed between a common electrode VCOM and a pixel electrode, and a retention capacitor formed between the common electrode VCOM and a retaining electrode. For example, the R sub-pixel 102A includes a TFT 105A, a liquid crystal capacitor 106A, and a retention capacitor 107A, and the R sub-pixel 102B includes a TFT 105B, a liquid crystal capacitor 106B, and a retention capacitor 107B. Other sub-pixels are similarly structured.

When a certain gate line Gi is selected, the R sub-pixel 102A connected to the gate line Gi is driven with a drive voltage supplied from the data line Ri(A), and the R sub-pixel 102B connected to the gate line Gn is driven with a drive voltage supplied from the data line Ri(B). The same goes for the G pixels 103 and the B pixels 104. When a certain gate line Gi is selected, the G sub-pixel 103A and the B sub-pixel 104A connected to the gate line Gi are driven with drive voltages supplied from the data lines Gi(A) and Bi(A), respectively, and the G sub-pixel 103B and the B sub-pixel 104B both connected to the gate line Gi is driven with drive voltages supplied from the data lines Gi(B) and Bi(B), respectively.

In the liquid crystal display panel with the configuration shown in FIGS. 1 and 2, the two sub-pixels are driven with different drive voltages for the same value of the image data. In other words, two sub-pixels within each pixel are driven in accordance with different gamma curves. Therefore, the generation of the drive voltages for driving the two sub-pixels requires gamma corrections in accordance with different gamma curves. In order to provide gamma corrections in accordance with different gamma curves, the liquid crystal display device shown in FIGS. 1 and 2 adopts a special drive method which is not commonly used in common liquid crystal display devices.

Japanese Laid Open Patent Application No. JP-P2007-226242A discloses a technique of driving a liquid crystal display panel of the configuration shown in FIGS. 1 and 2. FIG. 3 is a block diagram showing the configuration of a liquid crystal display device 100 disclosed in this Japanese patent application. The liquid crystal display device 100 is provided with a liquid crystal panel 110 structured as shown in FIGS. 1 and 2, a storage unit 120, a timing controller 130, a gate driver 140, and a data driver 150. Since an architecture in which the liquid crystal display is constructed with a timing controller IC (Integrated Circuit), a gate drive IC, a data driver IC is one of the common architectures of the liquid crystal displays, the person skilled in the art would understand that the timing controller 130, the gate driver 140, and the data driver 150 correspond to a timing controller IC, a gate driver IC, and a data driver IC, respectively. The storage unit 120 includes a first storage part 122 containing an LUT describing a gamma curve for "high pixels" (namely, the R sub-pixel 102A, the G sub-pixel 103A, and the B sub-pixel 104A), and a second storage part 124 for containing an LUT describing a gamma curve for "low pixels" (namely, the R sub-pixel 102B, the G sub-pixel 103B, and the B sub-pixel 104B). The first and second storage parts 122 and 124 are each provided with different LUTs for red (R), green (G), and blue (B) colors.

The liquid crystal display device 100 operates as follows: The timing controller 130 generates first image data RH, GH and BH from image signals R, G and B using the LUTs stored in the first storage part 122, and also generates the second image data RL, GL, and BL from image signals R, G, and B using the LUTs stored in the second storage part 124. The timing controller 130 transmits the first image data RH, GH and BH and the second image data RL, GL and BL to the data driver 150. The data driver 150 drives the "high pixels" in response to the first image data RH, GH, and BH, and drives the "low pixels" responding to the image data RL, GL, and BL.

One drawback of the liquid crystal display device 100 of FIG. 3 is the increase in the data transmission amount to the data driver 150 (or the data driver IC). The liquid crystal display device 100 shown in FIG. 3 requires transmitting two pieces of image data (i.e. the first and second image data) for each pixel. The liquid crystal display device 100 shown in FIG. 3 requires increased bit widths in transmitting the first and second image data. For a case where the image signals R, G and B are all 10-bits data, for example, the bit widths of the first image data RH, GH and BH and the second image data RL, GL and BL must be more than 10 bits (e.g. 12 bits), for performing gamma correction on the image signals R, G, and B. Therefore, the liquid crystal display device 100 undesirably requires transmitting an increased amount of data to the data driver 150. This necessitates an increased data transfer rate to transmit an increased amount of data within each horizontal period, the length of which is standardized in the standard use. The increase in the data transfer rate is not preferable, because this may increase the data error rate.

SUMMARY

In an aspect of the present invention, a liquid crystal display device is provided with a liquid crystal display panel, and a data driver IC that drives the liquid crystal display panel. The liquid crystal display panel is provided with a gate line, first and second data lines, and a pixel that includes a first sub-pixel connected to the gate line and the first data line, and a second sub-pixel connected to the gate line and the second data line. The data driver IC is provided with a gamma correction circuitry and a drive circuitry. The gamma correction circuitry generates first gamma-corrected data by performing gamma correction on externally received image data in accordance with a first gamma curve, and generates second gamma-corrected data by performing gamma correction on the image data in accordance with a second gamma curve. The drive circuitry drives the first data line in response to the first gamma-corrected data and drives the second data line in response to the second gamma-corrected data.

Such architecture effectively reduces the data transfer amount to the data driver IC for driving the liquid crystal display panel in which each pixel includes a plurality of sub-pixels.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 4:
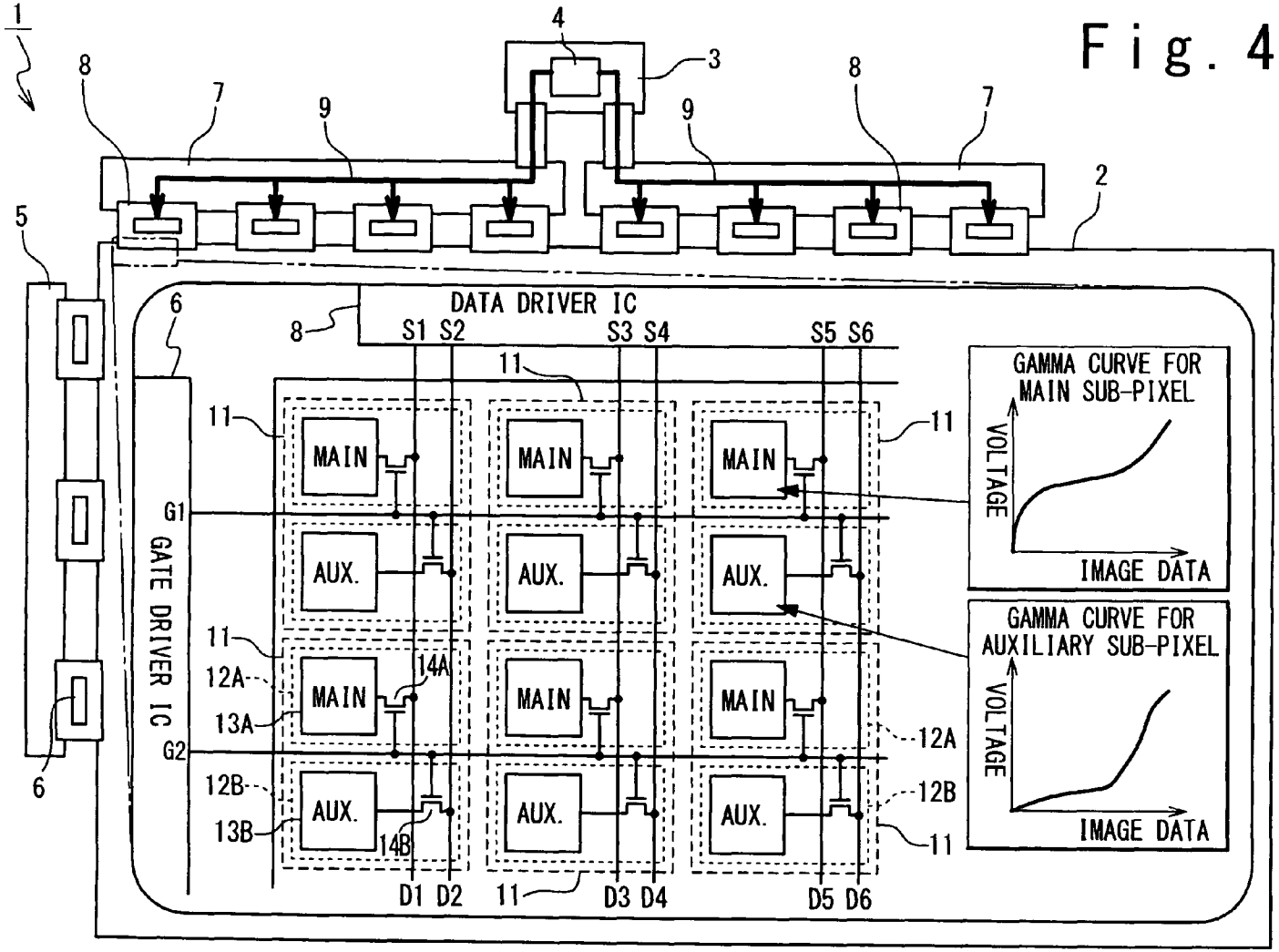
FIG. 4 is a block diagram showing an exemplary configuration of a liquid crystal display device of a first embodiment of the present invention.

FIG. 4 is a block diagram showing an exemplary configuration of a liquid crystal display 1 of a first embodiment of the present invention. The liquid crystal display 1 is provided with a liquid crystal display panel 2, a timing controller IC 4 provided on a substrate 3, gate driver ICs 6 provided on a substrate 5 and data driver ICs 8 provided on a substrate 7.

The liquid crystal display panel 2 is provided with gate lines G1, G2, . . . , data lines D1, D2, D3, D4, . . . , and pixels 11 provided at intersections of the gate and data lines. The liquid crystal display panel 2 of this embodiment is structured so that each pixel 11 includes two sub-pixels: a main sub-pixel 12A and an auxiliary sub-pixel 12B. Two data lines are provided along each column of the pixels 11. The data lines D1 and D2 are provided along the leftmost column of pixels 11, the data lines D3 and D4 are provided along the second leftmost column of pixels 11, and the data lines D5 and D6 are provided along the third leftmost column of pixels 11. The main sub-pixels 12A are connected to odd-numbered data lines D(2*i*-1), and the auxiliary sub-pixels 12B are connected to even-numbered data lines D(2*i*). The main sub-pixel 12A and the auxiliary sub-pixel 12B within the same pixel 11 are commonly connected to the same gate line. For example, the main sub-pixel 12A and the auxiliary sub-pixel 12B provided in the uppermost line of pixels 11 are commonly connected to the gate line G1. In this embodiment, pixels 11 aligned along a certain gate line may be referred to as the pixels 11 in one horizontal line.

The main sub-pixels 12A are each provided with a pixel electrode 13A and a TFT 14A, while the auxiliary sub-pixels 12B are each provided with a pixel electrode 13B and a TFT 14B. The TFT 14A is provided between the pixel electrode 13A and the corresponding odd-numbered data line S(2*i*-1), and the TFT 14B is provided between the pixel electrode 13B and the corresponding even-numbered data line S(2*i*). The gates of the TFTs 14A and 14B provided within the main sub-pixel 12A and the auxiliary sub-pixel 12B of the same pixel 11 are connected to the same gate line. Although the configuration of the liquid crystal display panel 2 is shown only partially in FIG. 4, the skilled person would appreciate that the whole of the liquid crystal display panel 2 is constructed similarly.

Figure 1:
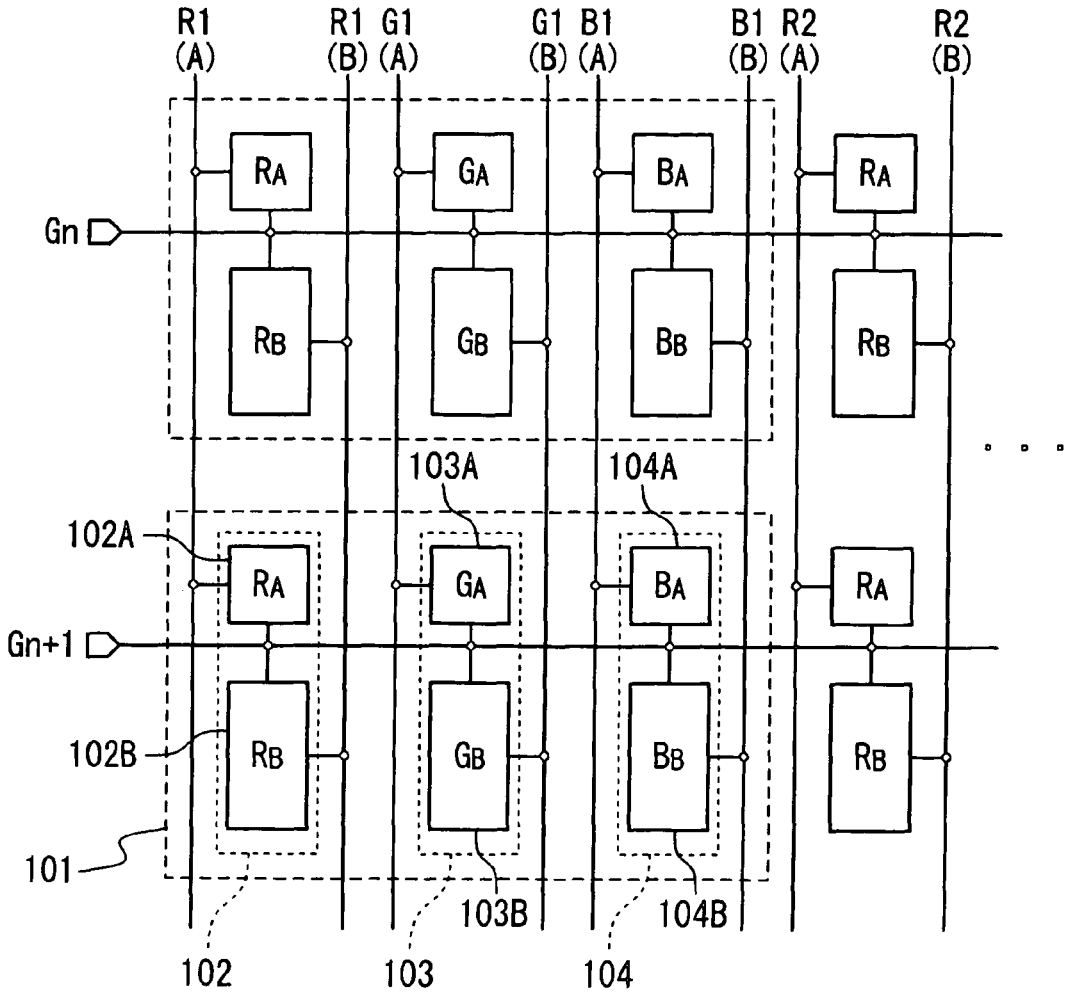
Fig. 1 PRIOR ART
FIG. 1 is a conceptual diagram showing a typical configuration of a liquid crystal display panel in which each pixel is composed of two sub-pixels.
Figure 2:
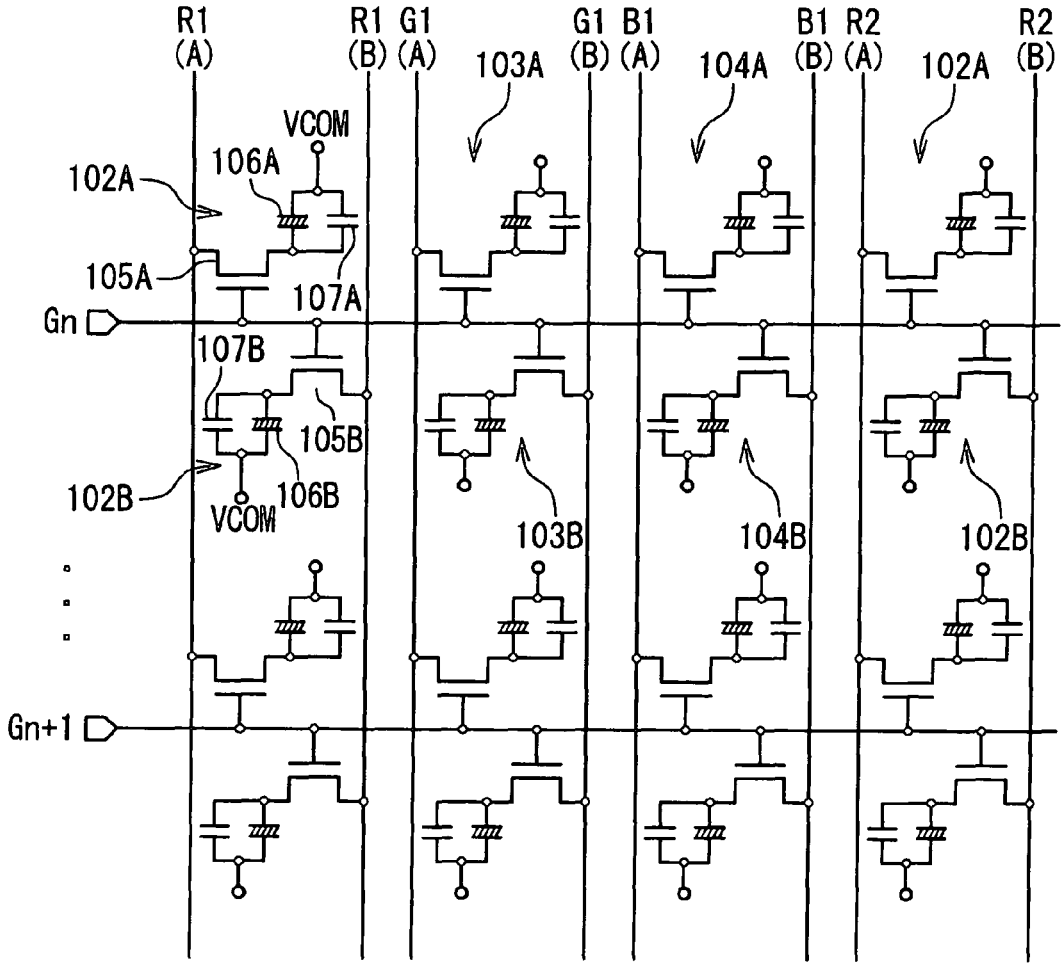
Fig. 2 PRIOR ART
FIG. 2 is a circuit diagram showing the configuration of a conventional liquid crystal display panel in which each pixel is composed of two sub-pixels.
Figure 3:
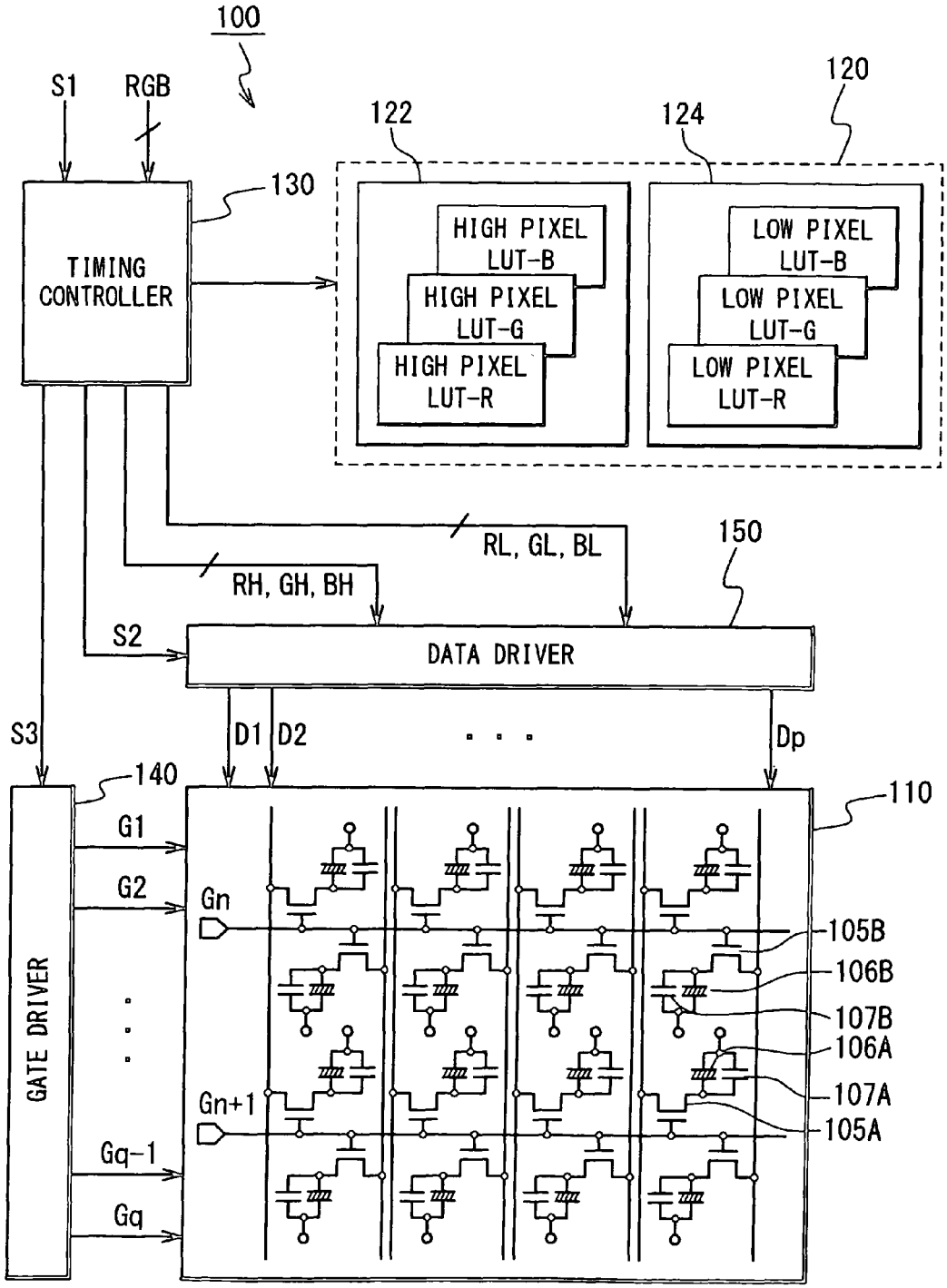
Fig. 3 PRIOR ART
FIG. 3 is a block diagram showing the configuration of a conventional liquid crystal display.

The timing controller IC 4 serially transmits image data 9 to the data driver ICs 8. In this embodiment, the image data 9 are 10-bit data that represent the grayscale level of each pixel with 10 bits. It should be noted that the image data 9 are transferred from the timing controller IC 4 to the data driver IC 8 before being subjected to the gamma correction, differently from the liquid crystal display device shown in FIG. 3. In addition, the timing controller IC 4 provides timing control of the data driver IC 8 and the gate drive IC 6 by supplying timing control signals (not illustrated) to the data driver IC 8 and the gate drive IC 6.

The gate drive IC 6 sequentially drives gate lines Gi of the liquid crystal display panel 2.

Data lines Di are connected to source outputs Si of the data driver ICs 8, and the data driver IC 8 drives the data lines Di of the liquid crystal display panel 2 in response to the image data 9. Specifically, the data driver ICs 8 drive the main sub-pixels 12A connected to the odd-numbered data lines D(2*i*-1) by outputting drive voltages from odd-numbered source outputs S(2*i*-1), and drives the auxiliary sub-pixel 12B connected to the even-numbered data lines D(2*i*) by outputting drive voltages from even-numbered source outputs S(2*i*).

The data driver ICs 8 of this embodiment are each configured to perform gamma corrections in accordance with different gamma curves on the main sub-pixel 12A and the auxiliary sub-pixel 12B within each pixel 11. That is, a data driver IC 8 drives the main sub-pixel 12A within a target pixel depending on the data generated by gamma correction on the corresponding image data 9 in accordance with the first gamma curve (hereinafter referred to as a gamma curve "A"), while driving the auxiliary sub-pixel 12B within the target pixel depending on the data generated by gamma correction on the corresponding image data 9 in accordance with the second gamma curve (hereinafter referred to as a gamma curve "B"). It should be noted that the gamma correction is performed within the data driver IC 8, differently from the liquid crystal display device 100 shown in FIG. 3.

Figure 5:
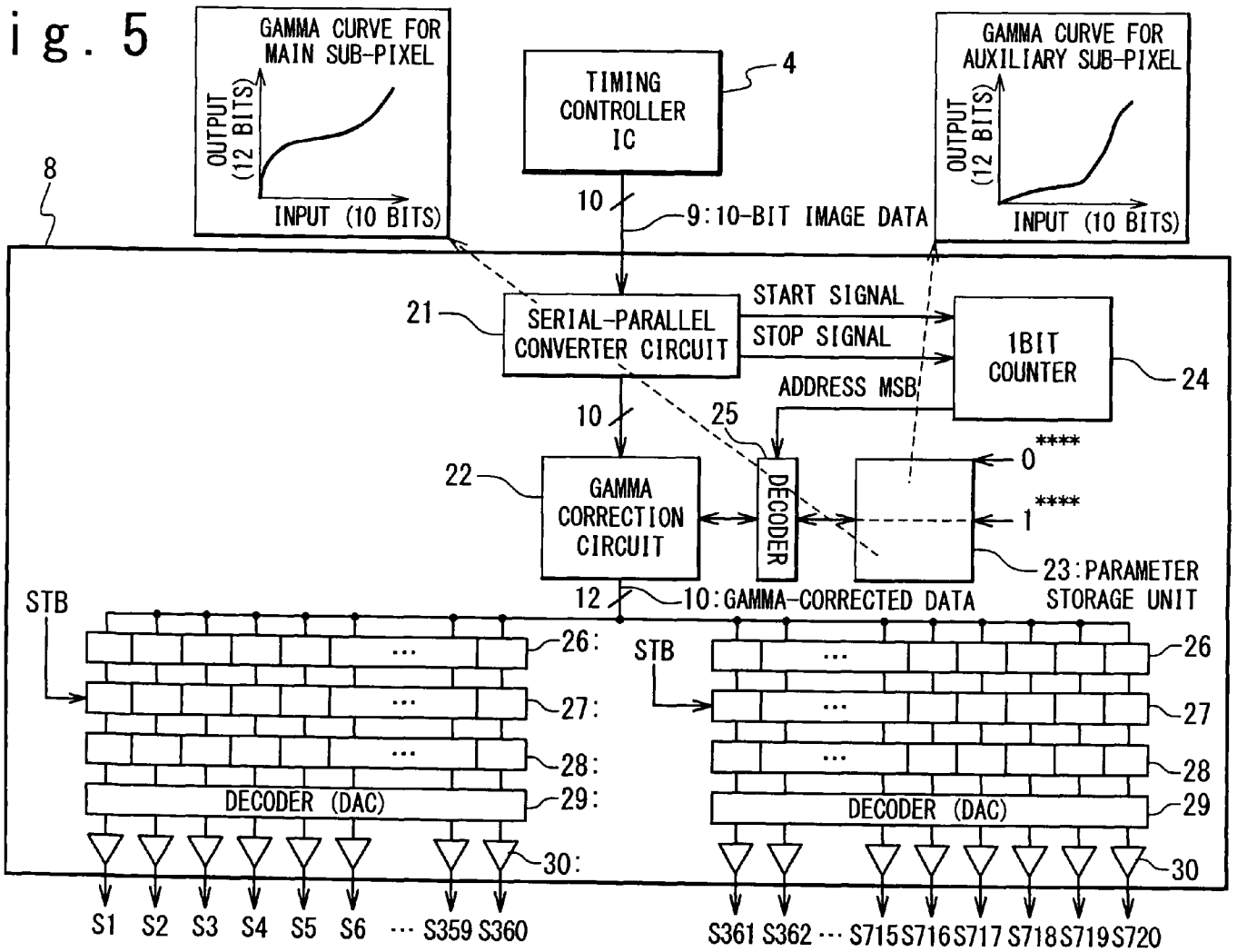
FIG. 5 is a block diagram showing an exemplary configuration of a data driver IC of the first embodiment.

FIG. 5 is a schematic diagram showing an exemplary configuration of the data driver ICs 8. In FIG. 5, shown is an exemplary configuration of the data drives IC 8 for the case where each data driver IC 8 is provided with 720 source outputs S1 to S720; each data driver IC 8 drives 360 pixels 11 in every horizontal period. The data driver IC 8 is provided with a serial-parallel converter circuit 21, a gamma correction circuit 22, a parameter storage unit 23, a 1-bit counter 24, a decoder 25, 12-bit latch circuits 26, 27, level shifters 28, 12-bit decoders 29, and amplifier circuits 30. The numbers of the latch circuits 26, 27, the level shifters 28, and the decoders 29 are equal to the number of the source outputs of each data driver IC 8. In the configuration of FIG. 5, 720 source outputs S1 to S720 are provided for each data driver IC 8, and the numbers of the latch circuits 26, 27, the level shifters 28, the decoders 29, and the amplifier circuits 30 are all 720 accordingly.

The serial-parallel converter circuit 21 performs serial-parallel conversion on the image data 9 transmitted serially, and feeds the serial-parallel converted image data 9 to the gamma correction circuit 22.

The gamma correction circuit 22, the parameter storage unit 23, the 1-bit counter 24, and the decoder 25 constitute a gamma correction circuitry for generating gamma-corrected data 10 by performing gamma correction on the image data 9. In this embodiment, the gamma-corrected data 10 are 12-bit data, whereas the image data 9 are 10-bit data.

In detail, the parameter storage unit 23 stores calculation parameters for performing gamma correction in accordance with the gamma curve "A" (namely, gamma correction to be performed on the main sub-pixels 12A) by an approximate calculation, and calculation parameters for performing gamma correction with the gamma curve "B" (namely, gamma correction to be performed on the auxiliary sub-pixels 12B) by an approximate calculation. It should be noted that the calculation parameters are data used to determine the approximate formula used for calculating grayscale values of the gamma-corrected data 10 from the grayscale values of the image data 9. For example, undetermined coefficients included in the approximate formula may be stored in the parameter storage unit 23 as the calculation parameters. The calculation parameters for performing the approximate calculation in accordance with the gamma curve "A" are stored at the addresses whose most significant bit is "1" in the parameter storage unit 23, and the calculation parameters for performing the approximate calculation in accordance with the gamma curve "B" are stored at the addresses whose most significant bit are "0."

The counter 24 contains a one-bit counter value which specifies whether the access to the parameter storage unit 23 is to be made to the calculation parameters of the gamma curve "A" or to those of the gamma curve "B". In detail, the counter value of the counter 24 is fed to the decoder 25 as the most significant bit of the destination address of the parameter storage unit 23, to thereby indicate whether the access is to be made to the calculation parameters of the gamma curve "A" or to those of the gamma curve "B". In detail, when a start signal is activated, the counter 24 starts to toggle the counter value between "0" and "1" at a frequency twice the frequency at which the image data 9 for each pixel are received. The counter value is fed to the decoder 25 to indicate the most significant bit of the address of the parameter storage unit 23. When a stop signal is activated, the counter 24 stops toggling the counter value, and is then reset.

The decoder 25 receives the image data 9 from the gamma correction circuit 22, and selects the destination address of the parameter storage unit 23, acknowledging the counter value received from the counter 24 as the most significant bit of the destination address and the image data 9 received from the gamma correction circuit 22 as the lower bits of the destination address.

The gamma correction circuit 22 generates the gamma-corrected data 10 by performing an approximate gamma correction calculation on the image data 9 by using the calculation parameters received from the selected destination address of the parameter storage unit 23. The generated gamma-corrected data 10 are fed to the latch circuits 26. As described later, the gamma correction circuit 22 alternately outputs the gamma-corrected data 10 corrected in accordance with the gamma curve "A" corresponding to the main sub-pixels 12A and the gamma-corrected data 10 corrected in accordance with the gamma curve "B" corresponding to the auxiliary sub-pixels 12B.

The latch circuits 26, 27, the level shifter 28, the decoder 29, and the amplifier circuit 30 function as a drive circuitry that drives the data lines D1 to D720 connected to the source outputs S1 to S720 in response to the gamma-corrected data 10.

In detail, the latch circuits 26 sequentially receive the gamma-corrected data 10 transmitted from the gamma correction circuit 22. The latch circuits 26 are configured to sequentially receive the gamma-corrected data 10 from left to right. Therefore, the gamma-corrected data 10 transmitted odd-number-th are stored in the odd-numbered latch circuits 26, and the gamma-corrected data 10 transmitted even-number-th are stored in the even-numbered latch circuits 26. In other words, the gamma-corrected data 10 corrected with the gamma curve corresponding to the main sub-pixels 12A are stored in the latch circuits 26 associated with the odd-numbered source outputs S(2*i*-1), and the gamma-corrected data 10 corrected with the gamma curve corresponding to the auxiliary sub-pixels 12B are stored in the latch circuits 26 associated with the even-numbered source outputs S(2*i*).

The latch circuits 27 simultaneously latch the gamma-corrected data 10 stored in the latch circuits 26 in response to the activation of a strobe signal STB. The latch circuits 27 transfer the latched gamma-corrected data 10 to the decoders 29 through the level shifters 28. The decoders 29 performs D/A conversion on the gamma-corrected data 10 received from the latch circuits 27 to generate analog voltage signals corresponding to the grayscale values indicated by the gamma-corrected data 10. The amplifier circuits 30 drive the data lines D1 to D720 by outputting drive voltages from the source outputs S1 to S720 with voltage levels corresponding to the voltage levels of the analog voltage signals received from the decoders 29; the voltage levels of the drive voltages are basically same as the voltage levels of the corresponding analog voltage signals generated by the decoders 29.

Figure 6:
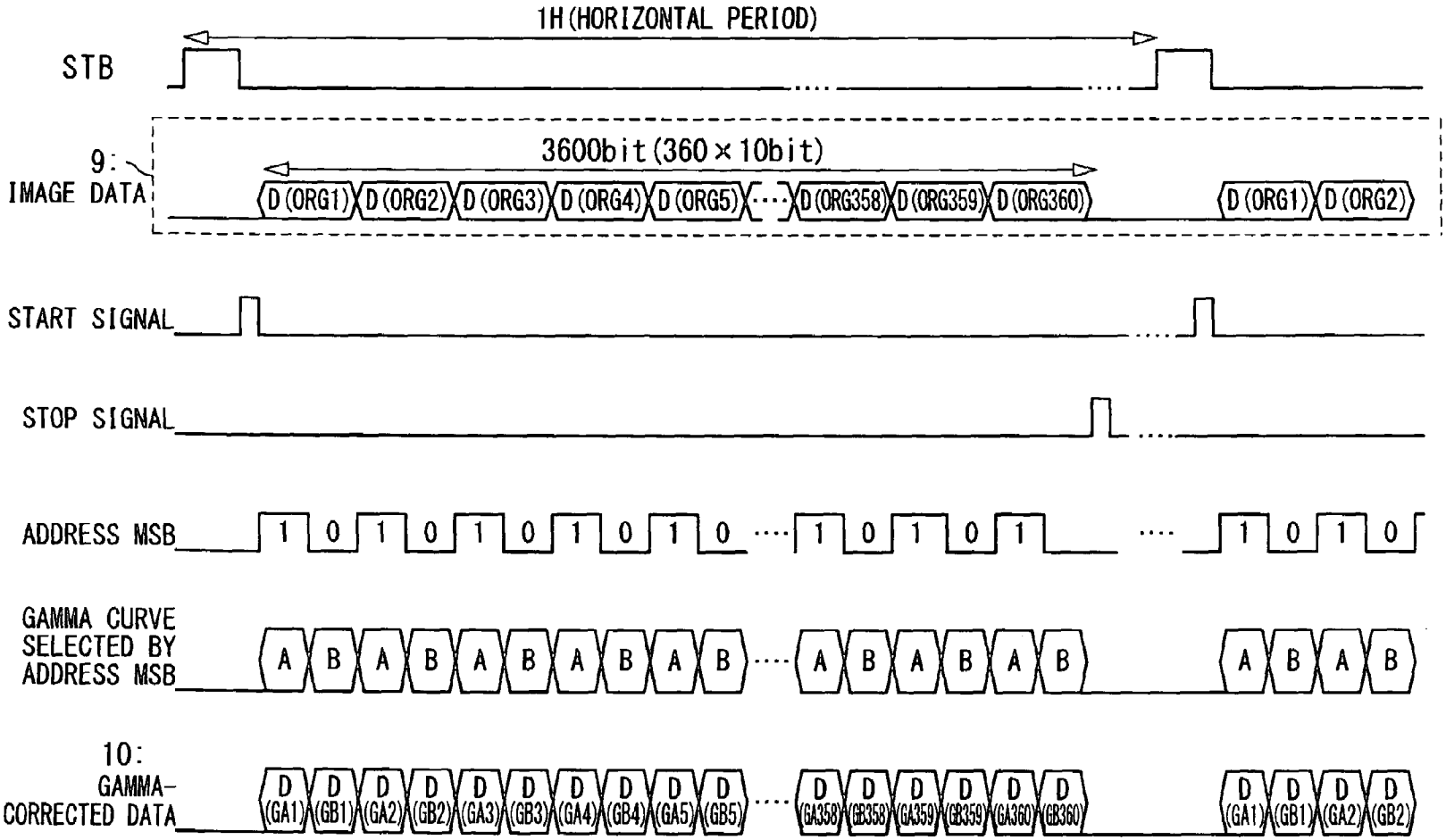
FIG. 6 is a timing chart showing an exemplary operation of the data driver IC in the first embodiment.

FIG. 6 is a timing chart showing an exemplary operation of the liquid crystal display 1 of this embodiment. In the following, the image data 9 corresponding to the respective pixels 11 in a horizontal line of interest are denoted by the symbols D(ORG1) to D(ORG360), respectively. The gamma-corrected data 10 generated by performing the gamma correction on the image data D(ORGk) with the gamma curve "A" corresponding to the main sub-pixel 12A are denoted by the symbol D(GAk). Correspondingly, the gamma-corrected data 10 obtained by performing the gamma correction on the image data D(ORGk) with the gamma curve "B" corresponding to the auxiliary sub-pixel 12B are denoted by the symbol described D(GBk).

In this embodiment, 360 image data D(ORG1) to D(ORG360) corresponding to the pixels 11 in one horizontal line are transferred to the data driver IC 8 in each horizontal period. Before the transmission of the image data D(ORG1) to D(ORG360), a start signal is activated to thereby start the operation of the counter 24. Next, the output of the counter 24 is set to "1", when the first image data D(ORG1) is transferred. This results in setting the most significant bit of the address to "1", allowing an access to the calculation parameters of the gamma curve "A" in the parameter storage unit 23. Furthermore, the decoder 25 receives the image data D(ORG1), and selects the address corresponding to the grayscale value of the image data D(ORG1). The gamma correction circuit 22 obtains the calculation parameters of the gamma curve "A" from the selected address, and performs the approximate gamma correction operation using the obtained calculation parameters and the image data D(ORG1) to thereby generate the gamma-corrected data D(GA1) corresponding to the image data D(ORG1). The gamma-corrected data D(GA1) outputted from the gamma correction circuit 22 are stored in the latch circuit 26 corresponding to the source output S1.

Next, the output of the counter 24 is set to "0". This results in setting the most significant bit of the address to "0", allowing an access to the calculation parameters of the gamma curve "B" in the parameter storage unit 23. The decoder 25 selects the address corresponding to the grayscale value of the image data D(ORG1). The gamma correction circuit 22 obtains the calculation parameters of the selected gamma curve "B", and performs the approximate operation using the obtained calculation parameter of the gamma curve "B" and the image data D(ORG1) to output the gamma-corrected data D(GB1) corresponding to the image data D(ORG1). The gamma-corrected data (GB1) outputted from the gamma correction circuit 22 are stored in the latch circuit 26 corresponding to the source output S2.

The gamma corrections are performed in the same way for the image data D(ORG2) to D(ORG360). This results in that the gamma-corrected data D(GAi) are stored in the latch circuits 26 corresponding to the odd-numbered source outputs S(2*i*-1), and the gamma-corrected data D(GBi) are stored in the latch circuits 26 corresponding to the even-numbered source outputs S(2*i*).

When the strobe signal STB is pulled up to the high level in the blanking period of the next horizontal period, the gamma-corrected data D(GA1), D(GB1), D(GA2), D(GB2), . . . , D(GA360), and D(GB360) prepared in the latch circuits 26 in the previous horizontal period are transferred to the latch circuit 27. This allows storing the gamma-corrected data D(GAi) in the latch circuits 27 corresponding to the odd-numbered source outputs S(2*i*-1), and the gamma-corrected data D(GB1) are stored in the latch circuits 27 corresponding to the even-numbered source outputs S(2*i*).

The source outputs S1 to S720 are then driven in response to the gamma-corrected data D(GA1), D(GB1), D(GA2), D(GB2), . . . , D(GA360), and D(GB360) transferred to the latch circuit 27. As a result, the main sub-pixels 12A are driven in response to the gamma-corrected data D(GA1) to D(GA360) generated by the gamma correction with the gamma curve "A," and the auxiliary sub-pixels 12B are driven in response to the gamma-corrected data D(GB1) to D(GB360) generated by the gamma correction with the gamma curve "B." It should be noted that the main sub-pixels 12A are connected to the odd-numbered source outputs S(2*i*-1) through the odd-numbered data lines D(2*i*-1), and the auxiliary sub-pixels 12B are connected to the even-numbered source outputs S(2*i*) through the even-numbered data lines D(2*i*).

One advantage of the liquid crystal display 1 of this embodiment is the reduction of the data transfer amount to the data driver IC 8, which results from the configuration in which the gamma correction is performed within the data driver IC 8. In the liquid crystal display device 100 shown in FIG. 3, the data transfer amount per pixel is 24 bits for the case where the image signals R, G, and B are each 10-bit data, and the first image data RH, GH, and BH, and the second image data RL, GL, and BL generated by the gamma correction are each 12-bit data. In this case, a data transfer rate of 668 Mbps is required when the liquid crystal display panel is driven by eight data driver ICs each having 720 channels. As for the liquid crystal display 1 of this embodiment, on the other hand, the data transfer quantity required for one pixel is 10 bits for a case where the image data 9 are 10-bit data. In this case, only a data transfer rate of 278 Mbps is required for a case where the liquid crystal display panel is driven by eight data driver ICs each having 720 channels. As thus described, the liquid crystal display device 1 of this embodiment effectively reduces the data transfer amount to the data driver ICs 8, and thereby allows decreasing the data transfer rate required for transferring the image data to the data driver ICs 8.

It should be noted that colors of respective pixels 11 are not mentioned in the above description of the present embodiment for easy understanding. In a commercially used liquid crystal display panel, the pixels 11 may include pixels of red color (R pixels), pixels of green color (G pixels), and pixel of blue color (B pixels). In this case, it is preferable that different gamma curves are used in the gamma corrections depending on the color of the pixel of interest. The skilled in the art would appreciate that such change is easily realized by preparing the following six sets of calculation parameters in the parameter storage unit 23:

(1) Calculation parameters associated with the gamma curve for the main sub-pixels within the R pixels;

(2) Calculation parameters associated with the gamma curve for the auxiliary sub-pixels within the R pixels;

(3) Calculation parameters of the gamma curve for the main sub-pixels within the G pixels;

(4) Calculation parameters associated with the gamma curve for the auxiliary sub-pixels within the G pixels;

(5) Calculation parameters associated with the gamma curve of the main sub-pixels of the B pixels; and (6) Calculation parameters associated with the gamma curve of the auxiliary sub-pixels of the B pixels, and by performing addressing to the parameter storage unit 23 in accordance with the colors of the respective pixels 11 of interest.

Although the parameter storage unit 23 is described as storing the calculation parameters for performing the approximate gamma correction operation in the present embodiment described above, LUTs (look-up tables) associated with the gamma curves may be stored in the storage unit 23 instead. In this case, the gamma correction circuit 22 performs table look-up to obtain the gamma corrected data corresponding to the image data from the LUTs corresponding to the associated gamma curves, and outputs the obtained gamma corrected data.

Second Embodiment

Figure 7:
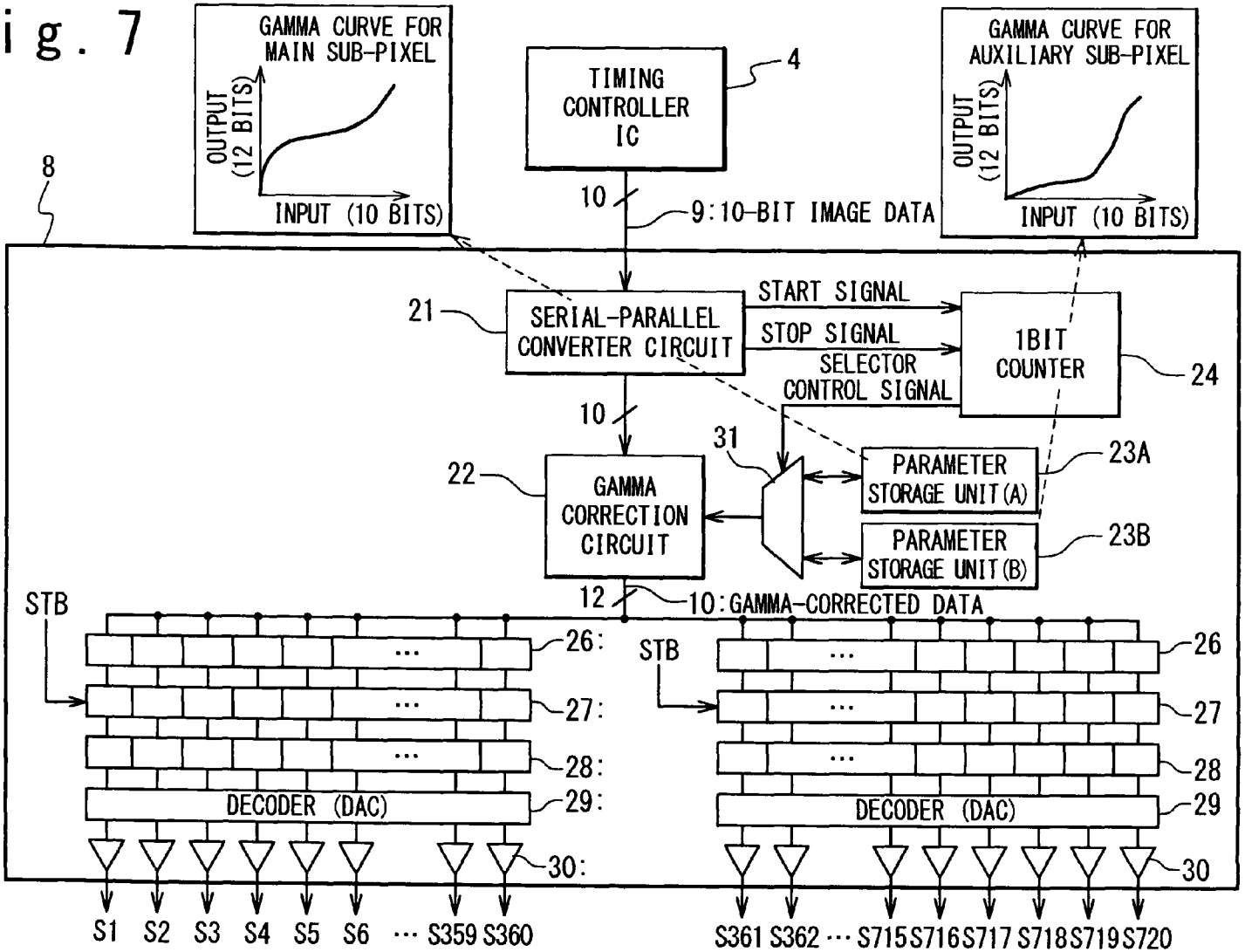
FIG. 7 is a block diagram showing an exemplary configuration of a data driver IC of a second embodiment.

FIG. 7 is a block diagram showing an exemplary configuration of the data driver IC 8 of the liquid crystal display 1 of a second embodiment of the present invention. The configuration of the data driver IC 8 of the second embodiment is almost similar to that of the first embodiment. The difference is as follows: First, the parameter storage unit 23 is replace with a parameter storage unit 23A for storing the calculation parameters for performing the approximate gamma-correction operation with the gamma curve "A" and a parameter storage unit 23B for storing the calculation parameters for performing the approximate gamma-correction operation with the gamma curve "B". Second, the decoder 25 is replaced with a selector 31. In this embodiment, the output of the counter 24 is supplied to the selector 31 as a selector control signal that switches the operation of the selector 31. The selector 31 selects one of the parameter storage units 23A and 23B depending on the output of the counter 24, and connects the selected storage unit to the gamma correction circuit 22. The gamma correction circuit 22 obtains calculation parameters from the address corresponding to the image data 9 of the selected parameter storage unit, and performs the approximate gamma correction operation using the obtained calculation parameters and the image data 9. The resultant image data, referred to as the gamma-corrected data 10, hereinafter, are transferred to the latch circuits 26.

Figure 8:
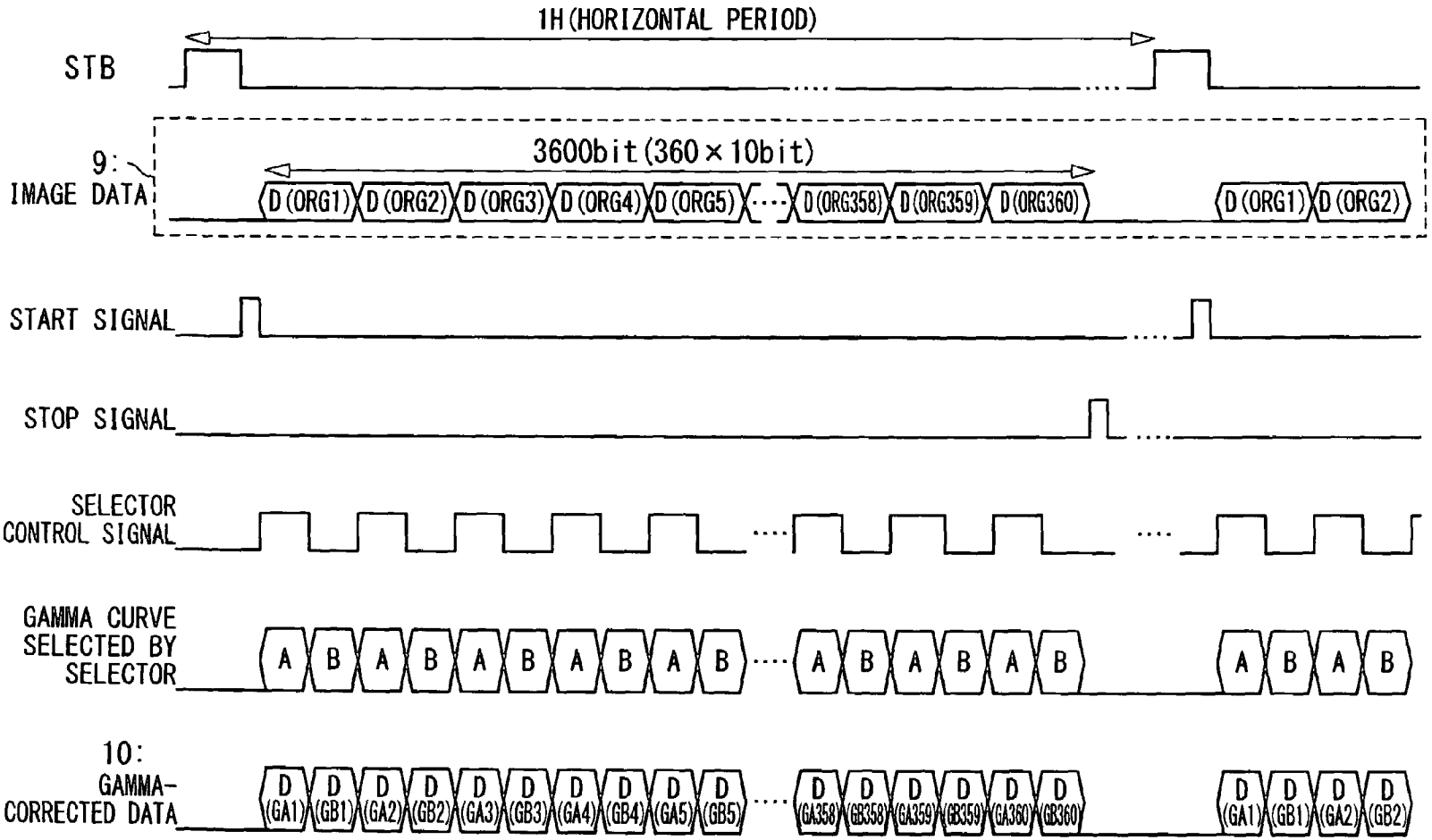
FIG. 8 is a timing chart showing an exemplary operation of the data driver IC in the second embodiment.

FIG. 8 is a timing chart showing an exemplary operation of the liquid crystal display 1 of the second embodiment. The operation of the liquid crystal display 1 in the second embodiment is almost similar to that in the first embodiment.

When the first image data D(ORG1) are transferred, the output of the counter 24 is set to "1" and the selector control signal is set to "1." As a result, the selector 31 selects the parameter storage unit 23A, allowing an access to the parameter storage unit 23A which stores the calculation parameters for performing the approximate operation with the gamma curve "A". The gamma correction circuit 22 obtains the calculation parameters of the gamma curve "A" from the address of the parameter storage unit 23A corresponding to the grayscale value of the image data D(ORG1), and performs an approximate operation using the calculation parameter of the gamma curve "A" and D(ORG1) to output the gamma-corrected data D(GA1) corresponding to the image data D(ORG1). The gamma-corrected data D(GA1) outputted from the gamma correction circuit 22 are stored in the latch circuit 26 corresponding to the source output S1.

Then, the output of the counter 24 is set to "0" and the selector control signal is set to "1." As a result, the selector 31 selects the parameter storage unit 23B, allowing an access to the parameter storage unit 23B which stores the calculation parameters for performing the approximate operation with the gamma curve "B". The gamma correction circuit 22 obtains the calculation parameters of the gamma curve "B" from the address of the parameter storage unit 23B corresponding to the grayscale value of the image data D(ORG1), performs an approximate operation using the calculation parameter of the gamma curve "B" and D(ORG1) to output the gamma-corrected data D(GB1) corresponding to the image data D(ORG1). The gamma-corrected data D(GB1) outputted from the gamma correction circuit 22 are stored in the latch circuit 26 corresponding to the source output S2.

The gamma corrections are performed in the same way for the image data D(ORG2) to D(ORG360). As a result, the gamma-corrected data D(GA1) are stored in the latch circuits 26 corresponding to the odd-numbered source outputs S(2*i*-1), and the gamma-corrected data D(GBi) are stored in the latch circuits 26 corresponding to the even-numbered source outputs S(2*i*).

The gamma-corrected data D(GA1), D(GB1), D(GA2), D(GB2), . . . , D(GA360), D(GB360) prepared in the latch circuits 26 are transferred to the latch circuits 27. Furthermore, the source outputs S1 to S720 are driven in response to the image data D(GA1), D(GB1), D(GA2), D(GB2), . . . , D(GA360) and D(GB360) transferred to the latch circuits 27. As a result, the main sub-pixels 12A are driven in response to the gamma-corrected data D(GA1) to D(GA360), which are generated by the gamma correction with the gamma curve "A," and the auxiliary sub-pixels 12B are driven in response to the gamma-corrected data D(GB1) to D(GB360), which are generated by the gamma correction with the gamma curve "B."

The liquid crystal display of the second embodiment, as is the case of the first embodiment, also effectively reduces the data transfer amount to the data driver IC 8, and thereby allows decreasing the data transfer rate required for transferring the data to the data driver IC 8.

Although the parameter storage units 23A and 23B in the second embodiment are described as storing the calculation parameters for performing the approximate gamma correction operation, the parameter storage units 23A and 23B may store LUTs (look-up tables) of the gamma curves instead of the calculation parameters. In this case, the gamma correction circuit 22 obtains the grayscale value of the gamma-corrected data corresponding to the image data from the LUTs of gamma curve, and outputs the resultant gamma-corrected data.

Third Embodiment

Figure 9:
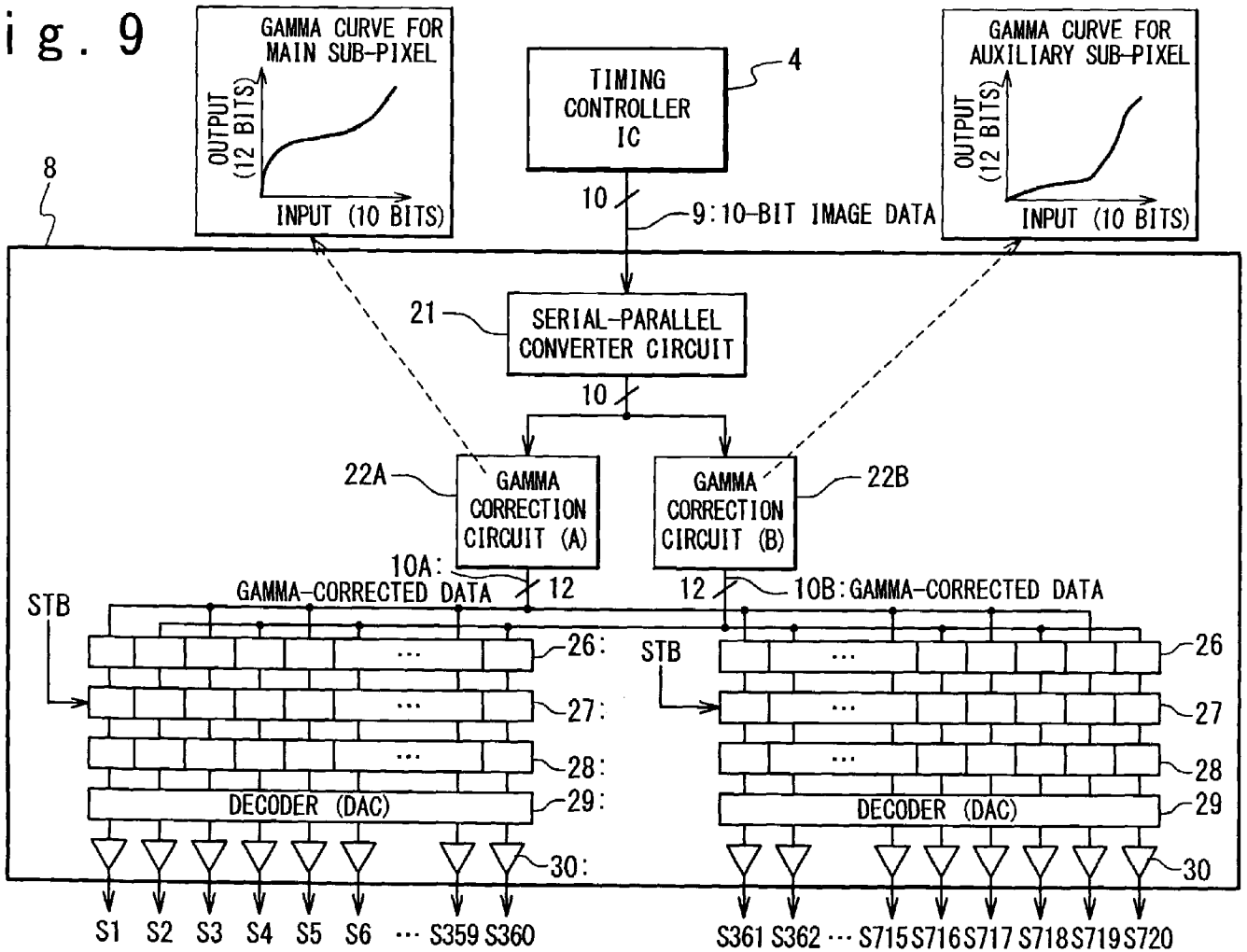
FIG. 9 is a block diagram showing an exemplary configuration of a data driver IC of a third embodiment.

FIG. 9 is a block diagram showing an exemplary configuration of the data driver IC 8 of the liquid crystal display 1 of a third embodiment of the present invention. In the third embodiment, two gamma correction circuits 22A and 22B are provided within the data driver IC 8. The gamma correction circuit 22A stores the calculation parameters associated with the gamma curve "A," and the gamma correction circuit 22A generates the gamma-corrected data 10A by performing the approximate gamma correction operation using the image data 9 and the calculation parameters associated with the gamma curve "A". On the other hand, the gamma correction circuit 22B stores the calculation parameters associated with the gamma curve "B," and the gamma correction circuit 22B generates the gamma-corrected data 10B by performing the approximate gamma correction operation using the image data 9 and the calculation parameters of the gamma curve "B".

The gamma-corrected data 10A, which are generated by the gamma correction circuit 22A, are stored in the latch circuits 26 corresponding to the odd-numbered source outputs S(2*i*-1), and the gamma-corrected data 10B, which are generated by the gamma correction circuit 22B, are stored in the latch circuits 26 corresponding to the even-numbered source outputs S(2*i*). It should be noted that, in this embodiment, signal lines connected between the gamma correction circuit 22A and the latch circuits 26 corresponding to the odd-numbered source outputs S(2*i*-1) are provided separately from signal liens connected between the gamma correction circuit 22B and the latch circuits 26 corresponding to the even-numbered source outputs S(2*i*-1). The gamma-corrected data 10A and 10B stored in the latch circuits 26 are transferred to the latch circuits 27, and then transferred to the decoder 29 from the latch circuits 27. As a result of these operations, drive voltages corresponding to the gamma-corrected data 10A are outputted from the odd-numbered source outputs S(2*i*-1), and drive voltages corresponding to the gamma-corrected data 10B are outputted from the even-numbered source outputs S(2*i*).

Figure 10:
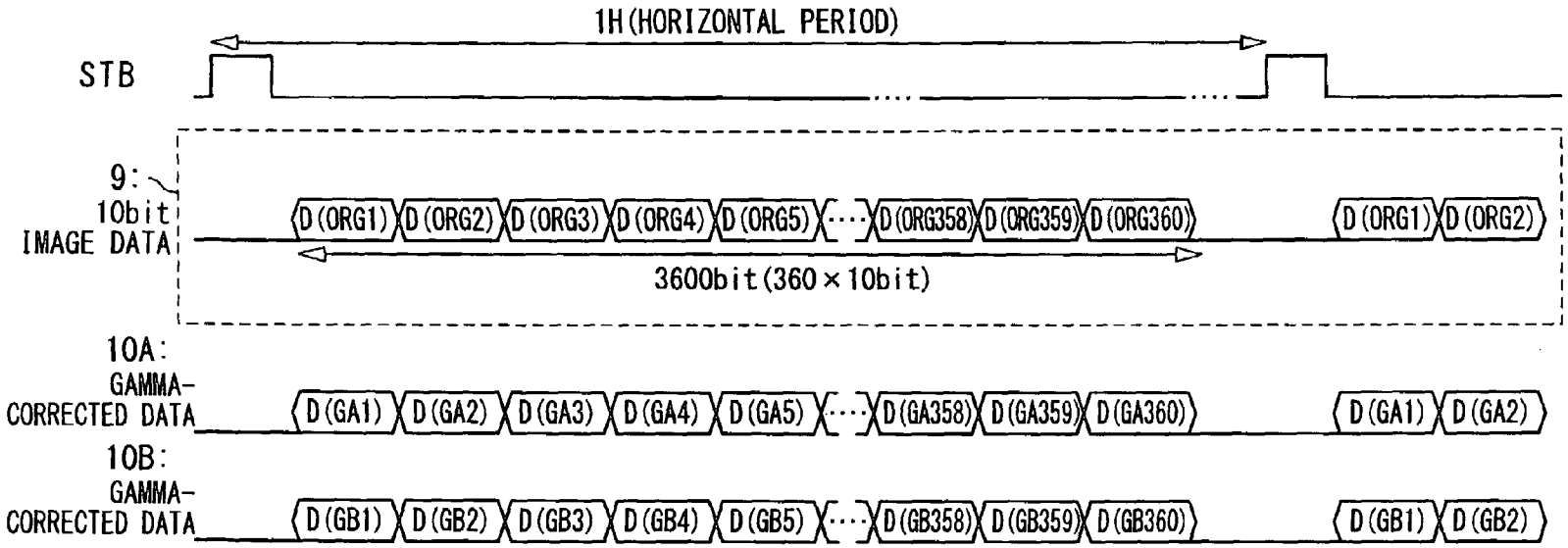
FIG. 10 is a timing chart showing an exemplary operation of the data driver IC in the third embodiment.

FIG. 10 is a timing chart showing an exemplary operation of the liquid crystal display 1 in the third embodiment. In this embodiment, image data D(ORG1) to D(ORG360) corresponding to the pixels 11 in one horizontal line are transferred to the data driver IC 8 in each horizontal period. When the first image data D(ORG1) is transferred to the data driver IC 8, the gamma correction circuit 22A performs gamma correction in accordance with the gamma curve "A" to generate the gamma-corrected data D(GA1), and the gamma correction circuit 22B performs gamma correction in accordance with the gamma curve "B" to generate the gamma-corrected data D(GB1). The gamma-corrected data D(GA1) outputted from the gamma correction circuit 22A are stored in the latch circuit 26 corresponding to the source line S1 and the gamma-corrected data D(GB1) outputted from the gamma correction circuit 22B are stored in the latch circuit 26 corresponding to the source line S2.

The gamma corrections are performed in the same way for the image data D(ORG2) to D(ORG360). As a result, the gamma-corrected data D(GAi) are stored in the latch circuits 26 corresponding to the odd-numbered source outputs S(2*i*-1), and the gamma-corrected data D(GBi) are stored in the latch circuits 26 corresponding to the even-numbered source outputs S(2*i*).

When the strobe signal STB is pulled up to the high level in the blanking period of the next horizontal period, the gamma-corrected data D(GA1), D(GB1), D(GA2), D(GB2), . . . , D(GA360), and D(GB360) prepared in the latch circuits 26 in the previous horizontal period are transferred to the latch circuits 27. As a result, the gamma-corrected data D(GAi) are stored in the latch circuits 27 corresponding to the odd-numbered source outputs S(2*i*-1), and the gamma-corrected data D(GBn) are stored in the latch circuits 27 corresponding to the even-numbered source outputs S(2*i*).

The source outputs S1 to S720 are then driven in response to D(GA1), D(GB1), D(GA2), D(GB2), . . . , D(GA360), and D(GB360) transferred to the latch circuits 27. As a result, the main sub-pixels 12A are driven in response to the gamma-corrected data D(GA1) to D(GA360) generated by the gamma correction with the gamma curve "A", and the auxiliary sub-pixels 12B are driven in accordance with the gamma-corrected data D(GB1) to D(GB360) generated by the gamma correction with the gamma curve "B."

The liquid crystal display device of the third embodiment, as is the cases of the first and second embodiments, effectively reduces the data transfer amount to the data driver IC 8, and thereby allows decreasing the data transfer rate required for transferring the data to the data driver IC 8. In addition, the liquid crystal display device of the third embodiment has an advantage that a slower operation speed of the gamma correction circuit is allowed compared to the liquid crystal display devices of the first and second embodiments. It should be noted, however, that the liquid crystal display devices of the first and second embodiments have an advantage that the hardware scale is reduced compared to the liquid crystal display device of the third embodiment.

Although the calculation parameters for performing the approximate gamma correction operation are stored in the gamma correction circuits 22A and 22B in the third embodiment, the LUTs (look-up tables) of the gamma curves may be stored therein instead. In this case, the gamma correction circuits 22A and 22B obtains the grayscale values of the gamma-corrected data corresponding to the image data from the LUTs of the gamma curves, and outputs the obtained gamma-corrected data.

It is apparent that the present invention is not limited to the above embodiments, but may be modified and changed without departing from the scope of the invention. It should be especially noted that the present invention is applicable to configurations where the number of the sub-pixels included in one pixel is three or more and the number of the data lines provided for one column of the pixels is three or more, although the above-described embodiments are directed to configurations in which one pixel is composed of two sub-pixels and two data lines are provided along each column of the pixels.

What is claimed is:

1. A liquid crystal display device comprising:

a liquid crystal display panel; and a data driver IC which drives the liquid crystal display panel, wherein said liquid crystal display panel includes:

a gate line;

first and second data lines; and a pixel which includes a first sub-pixel connected to said gate line and said first data line, and a second sub-pixel connected to said gate line and said second data line, wherein said data driver IC includes:

a gamma correction circuitry which generates a first gamma-corrected data by performing a gamma correction on externally received image data in accordance with a first gamma curve, and generates a second gamma-corrected data by performing a gamma correction on said externally received image data in accordance with a second gamma curve; and a drive circuitry which drives said first data line in response to said first gamma-corrected data and drives said second data line in response to said second gamma-corrected data, wherein said gamma correction circuitry includes:

a parameter storage unit storing first calculation parameters associated with said first gamma curve and second calculation parameters associated with said second gamma curve;

a counter operating in synchronization with reception of said image data;

a decoder for selecting an address of said parameter storage unit in response to said image data and a counter value received from said counter; and a gamma correction circuit generating said first gamma-corrected data and said second gamma-corrected data, wherein, when said counter value is a first value, said decoder selects an address of said parameter storage unit in which said first calculation parameters are stored and said gamma correction circuit generates said first gamma-corrected data by performing an approximate gamma correction calculation by using said selected first calculation parameters, and wherein, when said counter value is a second value, said decoder selects an address of said parameter storage unit in which said second calculation parameters are stored and said gamma correction circuit generates said second gamma-corrected data by performing an approximate gamma correction calculation by using said selected second calculation parameters.

2. A data driver IC for driving a liquid crystal display panel including a gate line, first and second data lines, a pixel which includes a first sub-pixel connected to said gate line and said first data line, and a second sub-pixel connected to said gate line and said second data line, said driver IC comprising:

a gamma correction circuitry which generates first gamma-corrected data by performing gamma correction on externally received image data in accordance with a first gamma curve, and generates second gamma-corrected data by performing gamma correction on said externally received image data in accordance with a second gamma curve; and a drive circuitry which drives said first data line in response to said first gamma-corrected data and drives said second data line in response to said second gamma-corrected data, wherein said gamma correction circuitry includes:

a parameter storage unit storing first calculation parameters associated with said first gamma curve and second calculation parameters associated with said second gamma curve;

a counter operating in synchronization with reception of said image data;

a decoder for selecting an address of said parameter storage unit in response to said image data and a counter value received from said counter; and a gamma correction circuit generating said first gamma-corrected data and said second gamma-corrected data, wherein, when said counter value is a first value, said decoder selects an address of said parameter storage unit in which said first calculation parameters are stored and said gamma correction circuit generates said first gamma-corrected data by performing an approximate gamma correction calculation by using said selected first calculation parameters, and wherein, when said counter value is a second value, said decoder selects an address of said parameter storage unit in which said second calculation parameters are stored and said gamma correction circuit generates said second gamma-corrected data by performing an approximate gamma correction calculation by using said selected second calculation parameters.

* * * * *